US005893209A

United States Patent [19]

Weeks et al.

[11] Patent Number: 5,893,209

[45] Date of Patent: Apr. 13, 1999

[54] APPARATUS FOR EFFECTING BOILER TUBE REMOVAL

[76] Inventors: Bruce V. Weeks, 12998 Worthington Rd. NW., Pataskala, Ohio 43062; Richard M. Arthur, 1236 Riker Dr., New Albany, Ohio 43054

[21] Appl. No.: 08/934,818

[22] Filed: Sep. 22, 1997

[51] Int. Cl.[6] ..... B23D 15/26

[52] U.S. Cl. ..... 29/727; 29/33 G; 29/890.031

[58] Field of Search ..... 29/727, 890.031, 29/33 G, 726; 408/1 R

[56] References Cited

U.S. PATENT DOCUMENTS

| | | | |
|---|---|---|---|
| 4,633,555 | 1/1987 | Legge | 29/890.031 |
| 4,830,551 | 5/1989 | Brennan et al. | 29/890.031 |
| 4,979,294 | 12/1990 | Bowman et al. | 29/890.031 |
| 5,033,347 | 7/1991 | Hillestad et al. | 29/890.031 |
| 5,044,075 | 9/1991 | Brennan et al. | 83/745 |
| 5,356,248 | 10/1994 | Hillestad | 408/1 R |
| 5,626,445 | 5/1997 | Nachbar et al. | 408/1 R |

*Primary Examiner*—Irene Cuda
*Attorney, Agent, or Firm*—Thomas S. Baker, Jr.

[57] ABSTRACT

A gap-cutter tool assembly for machining a longitudinal gap in an installed boiler tube is provided with clamp elements that engage the interior surface of the installed boiler tube, a cutter head track that provides a straight line cutting path within the tube interior and in the presence of different tube interior diameters, and a cutter head that co-operates with the cutter head track and that has different elevational positions during the cutter head cutting and return strokes, and at the end of the cutter head return stroke.

13 Claims, 6 Drawing Sheets

CONTROLLER
20
16
PRESSURIZED FLUID SUPPLY
18
CONTROL VALVES 10
2
52
22
14
12
12
12
24
2

APPARATUS FOR EFFECTING BOILER TUBE REMOVAL

CROSS-REFERENCES

None.

FIELD OF THE INVENTION

This invention relates generally to the maintenance of tube-type boilers, and particularly concerns both a method and tube-machining apparatus that may be advantageously utilized in connection with boiler maintenance operations such as those involving the removal of a boiler tube from installation in the headers of a tube-type boiler for subsequent replacement.

BACKGROUND OF THE INVENTION

A preferred tube removal practice for use in connection with maintenance operations for typical tube-type boilers involves cutting the boiler tube that is to be replaced at locations adjacent the boiler headers in which the tube is installed, removing the cut major tube length from within the boiler, and afterwards separately removing the two remaining tube ends mounted in the tube mounting bores of the boiler tube headers from within their tube mounting bores. The subsequent removal of the tube ends generally has involved the use of apparatus that is first clamped to the interior surface of nearby tubes or other tube ends installed in the same boiler tube header, and that is then subsequently actuated to machine a longitudinal gap or slit in the wall of tube end to be removed. Afterwards, and following apparatus removal, the candidate tube end is laterally compressed to close the machined longitudinal gap, and manually or otherwise withdrawn from installation within the boiler header tube mounting bore. The preferred practice of tube removal avoids the probable damage to the boiler header tube mounting bores that typically occurs when other methods of tube removal such as oxy-acetylene flame cutting or axial driving force separation are utilized, and thus effectively eliminates the probable need for subsequent header metal repair and header tube mounting bore redrilling and honing.

However, the known boiler tube machining apparatus has not been found to function optimumly in all instances, and particularly in cases where the tube interior diameter is not uniform throughout its length due to non-uniform mineral or oxide scale encrustation in the tube, or where adequate adjacent tubes or tube ends are not available for initial apparatus clamping. Accordingly, we have invented a novel apparatus that may be utilized to advantageously in-part effect the removal of boiler-tube ends from their mountings without causing damage to the co-operating boiler header tube mounting bores even in cases where significant non-uniformity of tube interior scaling exists or even if no adjacent boiler tubes or tube-ends are available for satisfactorily clamping the apparatus to the boiler header.

Other advantages and objectives of the invention will become apparent in the course of considering the detailed descriptions, drawings, and claims which follow.

SUMMARY OF THE INVENTION

The gap-cutter tool of the present invention is essentially a unitary assembly comprised of a tool head subassembly that includes multiple conventional actuator devices, a clamp subassembly that co-operates with the head subassembly and that is inserted in the tube to be replaced to secure the apparatus cutting position, a positionally adjustable cutter head support track assembly that has a straight-line cutter head track in its cutting length, and a head subassembly that co-operates with the adjustable cutter head support track subassembly and that includes tool cutter insert and cutter bit components. Utilized with the gap-cutter tool assembly are sources of electrical and pressurized fluid power, and power controls for controlling the head subassembly actuator devices and the sequencing of the operation of the clamp, cutter head support track, and articulated cutter head subassemblies.

From a method standpoint, the apparatus is first inserted into and clamped to the interior of the tube to be removed, a longitudinal gap is machined through the wall thickness of the candidate boiler tube, the apparatus is then removed from within the tube, the machined tube is afterwards cut cross-wise adjacent the boiler header and in a zone that includes the machined longitudinal gap, the machined tube end remaining within the boiler header is compressed laterally and/or circumferentially to close the machined gap, and lastly the compressed or collapsed tube end is withdrawn from installation within the boiler header without damage to the surface of the boiler header mounting bore.

DETAILED DESCRIPTION

Figure 1:
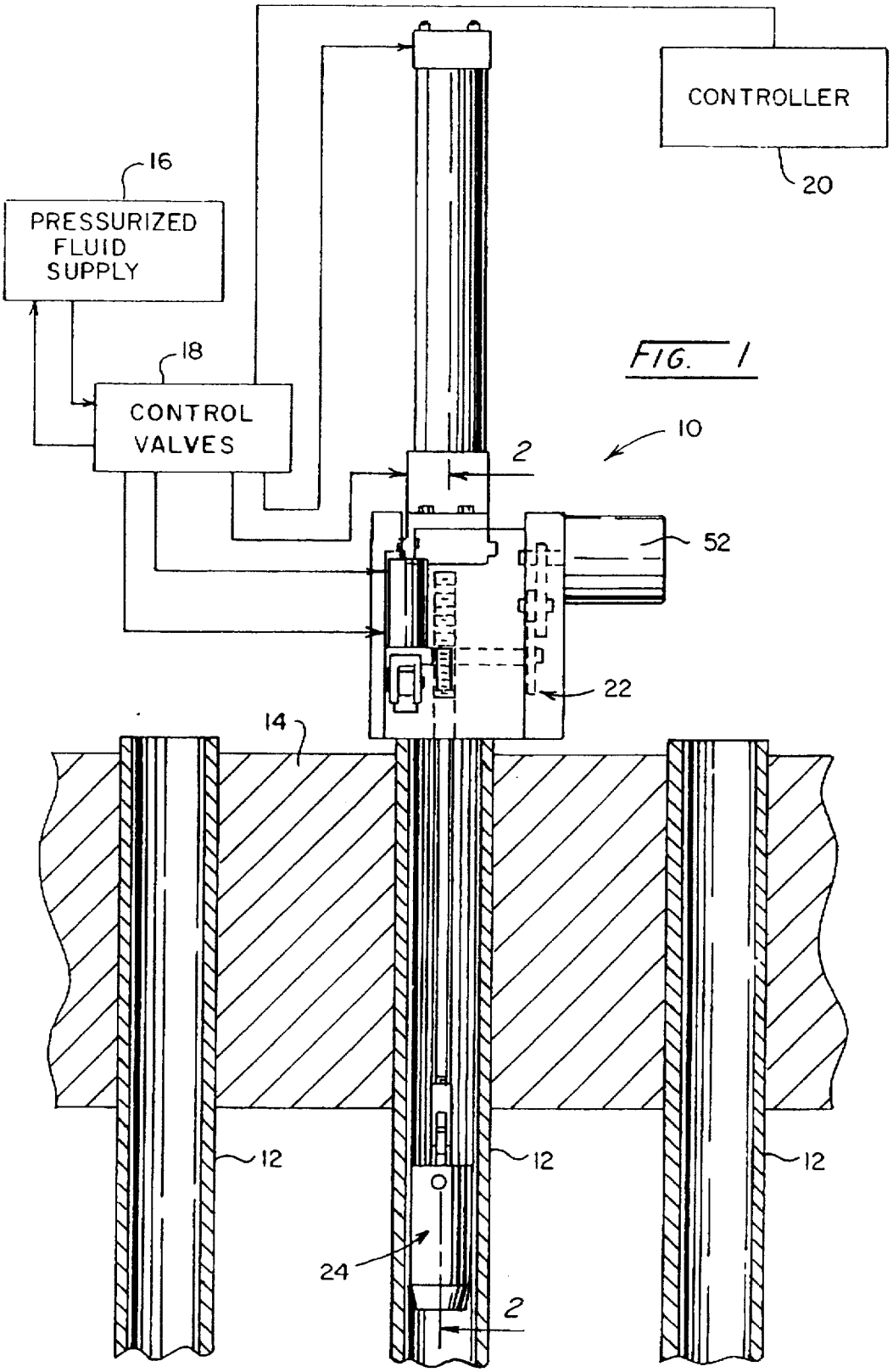
FIG. 1 is a schematic elevation view, partially in section, illustrating a preferred embodiment of the gap-cutter tool of the present invention as installed in a boiler tube end in which a longitudinal gap is to be machined.

In FIG. 1 we schematically illustrate a preferred embodiment of the gap-cutter tool 10 of our invention co-operating with one of several boiler tubes 12 mounted in boiler header 14 and in which the wall is to be machined to provide a longitudinal gap that facilitates subsequent removal of the tube end from its header installation. Also, illustrated in FIG. 1 for use with the gap-cutter tool invention 10 is a source of pressurized fluid 16, which may be either pressurized hydraulic fluid or pressurized air, a group of conventional fluid flow control valves 18 that direct the flow of pressurized fluid between pressurized fluid source 16 and the hereinafter-described actuator devices included in assembly 10, and a conventional controller 20 that regulates the sequential operation of particular fluid flow control valves and that also regulates the sequential operation of the hereinafter-described electrical stepper motor.

Tool assembly 10 basically is comprised of a tool head subassembly 22, a clamp subassembly 24, a cutter head support track subassembly 26, and a cutter head subassembly 28, each of which is described hereinafter in greater detail.

Note that FIGS. 1 through 5 illustrate the end of tube-end 12 that co-operates with gap-cutter tool assembly 10 as extending beyond the free end of clamp subassembly 24. Assembly 10 will function in a satisfactory manner as hereinafter explained if the free end of subassembly 24 projects beyond the end of tube-end 12, it only being necessary that the length of tube gap to be machined is within the range of the apparatus cutter head subassembly cutting stroke.

Tool head subassembly 22 essentially consists of a rigid adaptor block 30 which initially is installed in contacting relation with the cut tube end 12 that is to be provided with the machined gap, which in part functions as a housing to contain and support several different interiorly-mounted subassembly component parts, and which also supports several different exteriorly-located component parts. Securely joined to adaptor block 30 and at right-angles to the adaptor block surface that contacts the end surface of boiler cut tube end 12 are rigid and spaced-apart fixed guide rail elements 34 and 36. Slide member 32, structurally a part of the hereinafter-described cutter head support track subassembly, slidably dovetails with cross guide ways 38 and 40 provided in adaptor block 30, supports or carries conventional double-acting, pressurized fluid actuator 42, and has an oversize interior bore 44 through which the piston rod 46 of actuator 42 passes. Internal compression springs 48 are provided in tool head subassembly 22 and are arranged so that their lower ends bear against upper surfaces of the hereinafter described cutter head support track member. See FIG. 2.

Also included externally in tool head subassembly 22 is a double-acting clamp actuator element 50, which may be of a type that utilizes compressed air as a power source, and conventional electrical stepper motor 52. Mounted interiorly of adaptor block 30 is a clamp drive linkage comprised of clamp arm 54 which is connected to the piston rod 56 of actuator 50, which is pivoted about pin 58, and which has an opposite end hole or bore 60 that co-operates with a rail drive pin element of clamp subassembly 24. Also, preferably included within the interior of adaptor block 30 are the gear train 61, which operationally connects stepper motor 52 to cutter support subassembly 26, and pivoted clamp locking blades 62 (FIG. 5) that are biased toward a non-clamping condition by interior compression springs 64. (The ends of clamp locking blades 62 that project from within adaptor block 30 function as movable friction points that selectively contact the interior surface of tube end 12 when pivoted by the sliding action of a clamp rail and its included ramp surface in clamp subassembly 24).

Figure 6:
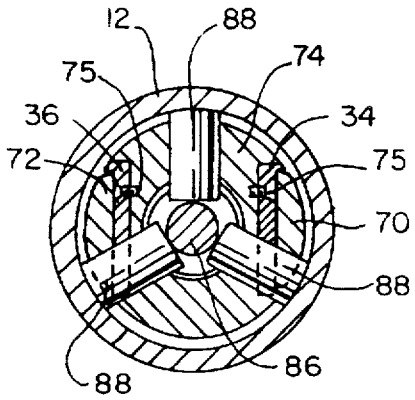
FIG. 6 is a section view taken at line 6—6 of FIG. 3.
Figure 5:
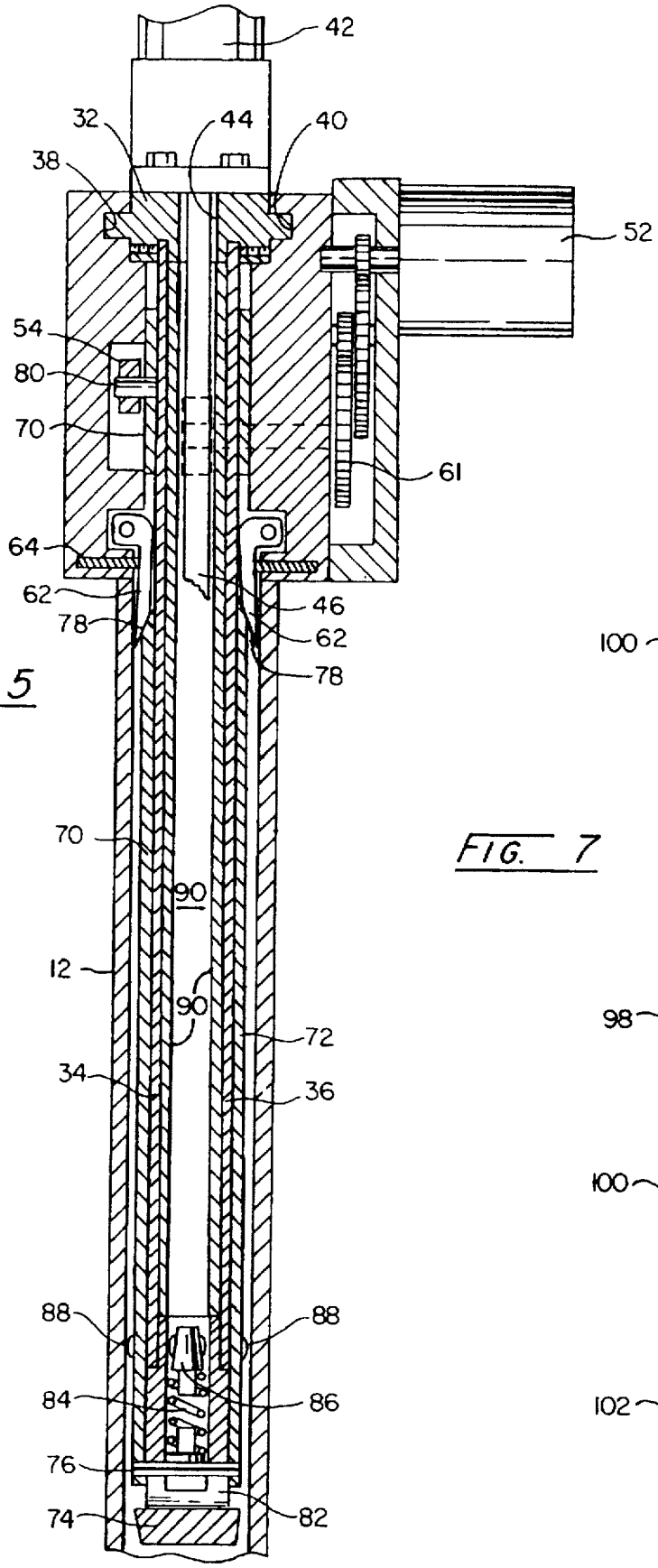
FIG. 5 is a section view taken at line 5—5 of FIG. 3.

The tool clamp subassembly 24 is basically comprised of a pair of elongated and longitudinally movable clamp side rails 70 and 72 that each have a segmental cross-section configuration, that are slidably inserted at their head ends into a corresponding recess in adaptor block 30, and that are interconnected into a unitary structure at their other ends by mechanical actuator housing 74 and co-operating screw-type fasteners 75. See FIG. 6. Each such clamp rail has a longitudinally intermediate ramp surface 78 that co-operates with a respective one of the clamp locking blades 62 incorporated into tool head subassembly 22. Also, clamp rail 70 is provided adjacent its extreme opposite mechanical actuator 74 with a drive pin 80 that is engaged with the bore 60 of pivoted clamp arm 54 that is included in tool head subassembly 22.

The body of mechanical actuator 74 includes a pair of elongated slots 82 in which through-pin element 76 slides as a consequence of longitudinal movement of clamp rails 70 and 72 by operation of clamp actuator 50. Movement of through-pin 76 within slots 82 (see FIG. 3) functions to first move actuator compression spring 84, actuator interior cone element 86, and the included three radially-slidable clamp pins 88, and causes the ends of those pins to securely contact the interior wall surface of cut tube length 12. Such clamping action involving radially-slidable clamp pins 88 occurs simultaneously with the clamping action induced into clamp locking blades 52 against the compression of blade spring element 54. The clamp pins 88 function as movable friction points that selectively engage the inner surface of boiler tube-end 12 when actuated. It should be noted that mechanical actuator element 74 can be modified to function with clamp locking blades similar to locking blades 62 in lieu of the radially-oriented clamp pin element 88. Also, if subassembly 24 becomes clamped at its actuator 74 end before clamping is completed at its adaptor block 30 end, as in the case where the tube interior diameter of the actuator 74 end is significantly smaller than the tube interior diameter at the adaptor block 30 end, the required additional longitudinal movement of clamp rails 70 and 72 can occur because compression spring 84 will be further compressed and thereby "take up" the additional movement without further moving radial clamp pins 88.

Figure 2:
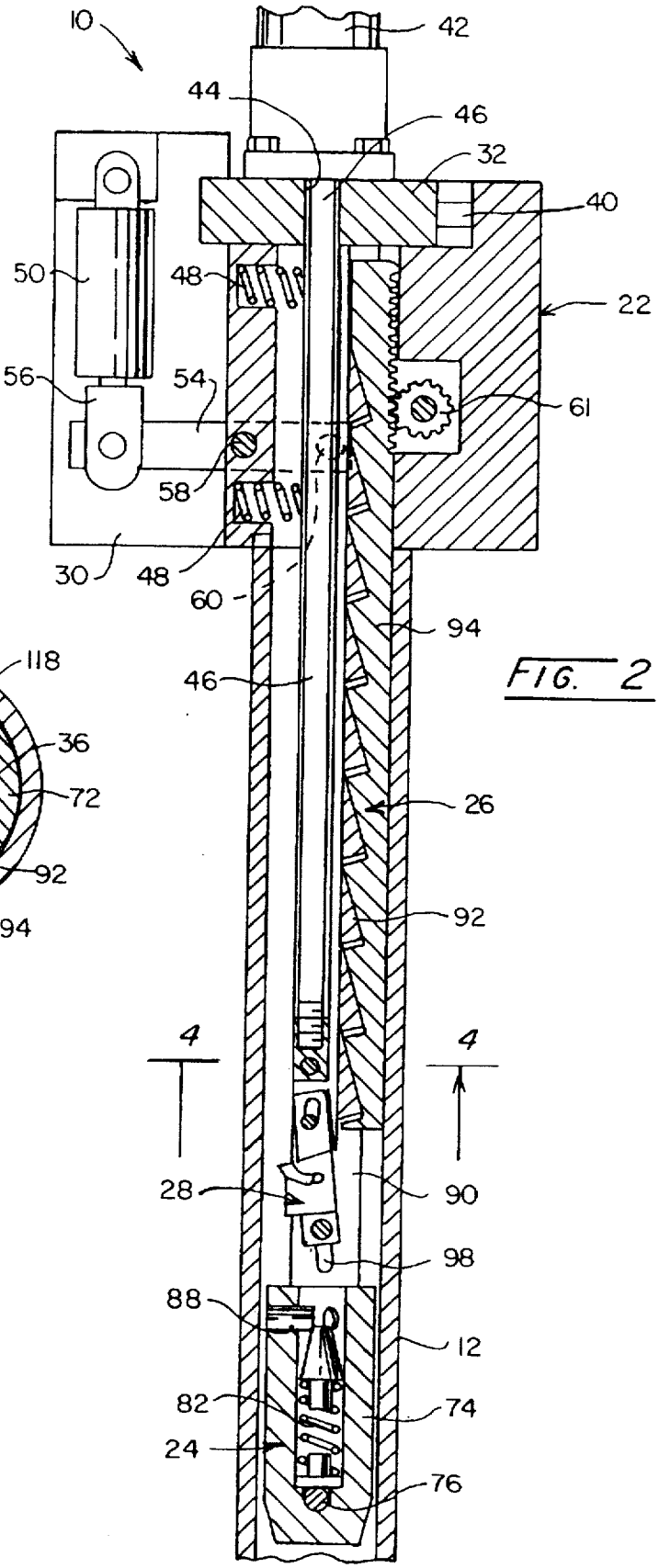
FIG. 2 is a section view taken at line 2—2 of FIG. 1.
Figure 4:
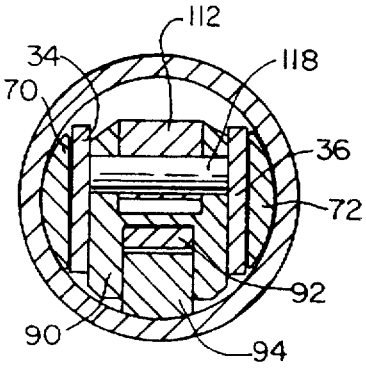
FIG. 4 is a section view taken at line 4—4 of FIG. 2.

It should be noted that clamp subassembly 24 in its installed position may be situated either completely within the interior limits of the boiler tube end 12 that is to be machined (FIG. 1), or alternatively, at least throughout the extent of the cut that is to be made if installed in a materially shorter tube end 12 (FIG. 2). Thus, even though the radial clamp pins 88 are useful in assuring centering the axis of apparatus assembly 10 within the tube end, they need not make contact with a tube end interior in order to adequately clamp assembly 10 in position during an apparatus cutting stroke because the tube reaction force during cutting tends to more forcefully draw apparatus 10 into the tube interior.

The cutter head support track subassembly 24 provided in gap-cutter tool assembly 10 is basically comprised of an elongated cutter head support member 90 that has an "H"-configured cross-section (see FIG. 4) and that has an elevationally adjustable position relative to the interior of cut tube-end 12. Cutter head support member 90 is rigidly joined to and carried by slide member 32 and is positioned in a manner whereby the support web that interconnects the support member spaced-apart upstanding legs of the "H"-configuration is oriented at right angles to the longitudinal axes of adaptor block cross-ways 38 and 40. The previously-described compression springs 48 bear against the uppermost extremes of the spaced-apart upstanding legs of cutter support member 90.

Changes in lateral (elevational) position of cutter support member 90 within tube-end 12 are achieved by relative movement between multi-ramp wedge shoe 92, which shoe is fastened to the underside of the interconnect web of cutter support member 90, and complementary-configured multi-ramp wedge rack element 94. Wedge rack element 94 has a toothed rack 96 adjacent one end, and that toothed rack co-operates with the gear train 61 that is powered by electrical stepper motor 18.

Figure 3:
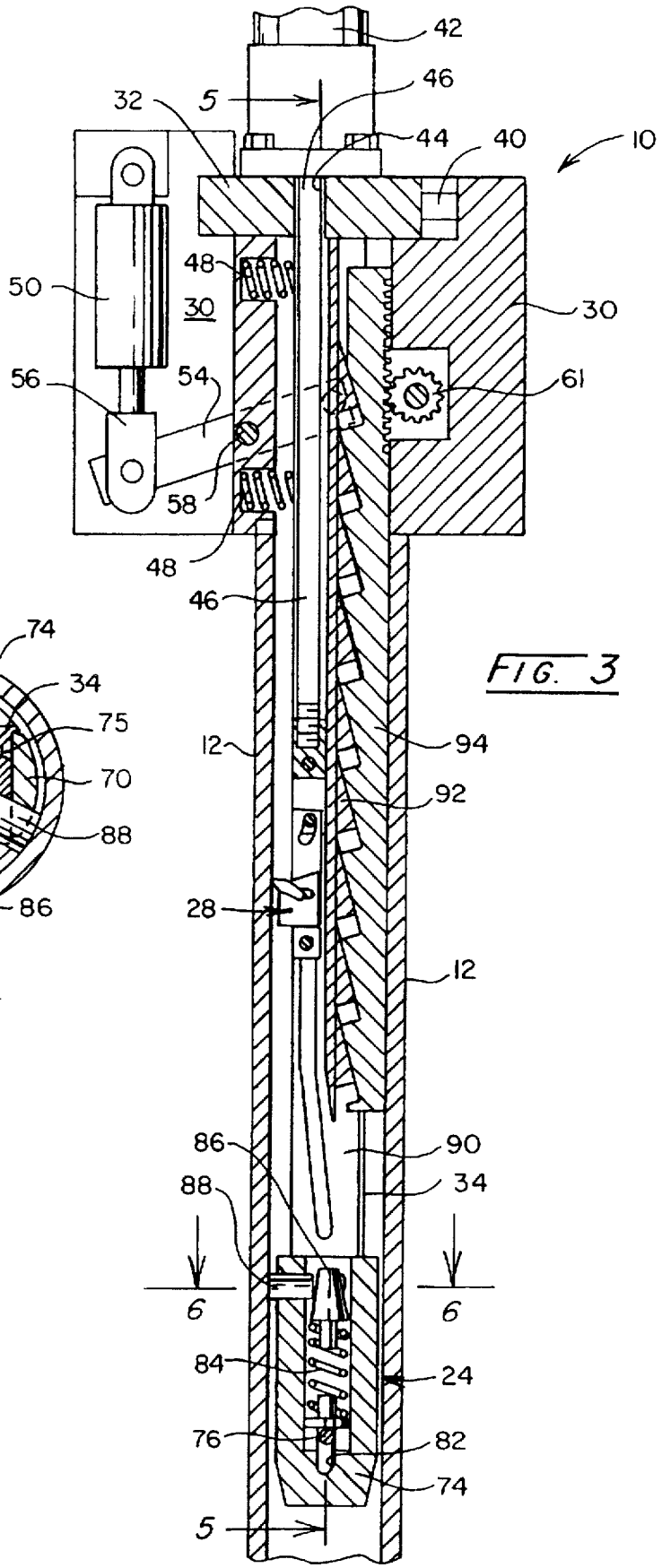
FIG. 3 is a section view similar to FIG. 2 but illustrating the tool cutter head subassembly in a cutting position.

The elevational change to the position of cutter support member 90 that is achieved by the relative movement occurring between wedge shoe element 92 and wedge rack element 94 may be more clearly understood by a comparison of their relative positions illustrated in FIGS. 2 and 3. In FIG. 2, cutter support member 90 is positioned at its elevationally lowest position. FIG. 3 illustrates support member 90 at an elevationally higher position than in FIG. 2—such as occurs when an individual longitudinal interior gap cut is being made in the wall of tube end 12 by apparatus 10. Upward movement of cutter support member 90 resulting from longitudinal displacement of multi-ramp rack element 94 by stepper motor 52 and gear train 61 does not involve any movement of co-operating fixed rails 34 and 36. The upward movement of cutter support member 90 and attached slide element 32 relative to cross-ways 38 and 40 further compresses each included compression spring 48. When multi-ramp wedge rack element 94 is moved longitudinally in an opposite direction, compression springs 48 will cause downward movement of cutter support member 90 and its attached underside wedge shoe element 92.

An important feature of cutter support member 90 is the pair of oppositely-positioned guide track elements 98 which are preferably machined as a slot in each of the upstanding legs of cutter support member 90. Each guide track element 98 has an elongated straight-run portion 100 and a connected, downwardly inclined, "dog-leg" portion 102. See FIG. 7. The hereinafter described tool articulated cutter head subassembly 28 co-operates directly with guide track elements 98, and is elevationally being advanced toward or withdrawn from contact with a wall of tube-end 12 whenever the elevational position of cutter support member 90 is being changed.

Figure 7:
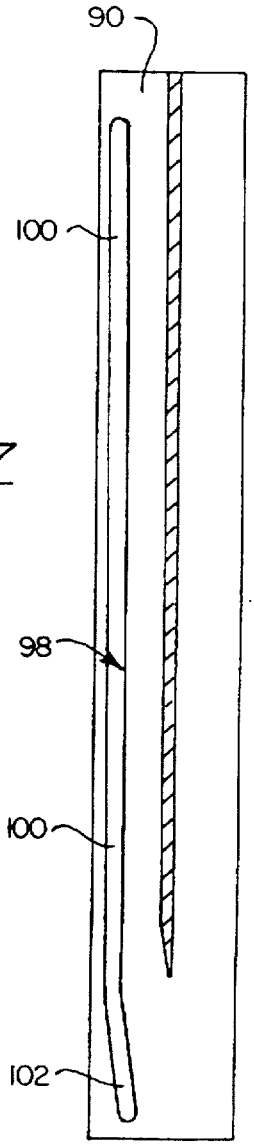
FIG. 7 is a side view of a cutter support member.

Although not illustrated in the drawings, it may be preferred to provide an alternate form for the FIG. 7 guide track elements 98 of apparatus support track subassembly 26 for use in cases wherein the tube mounting bore of boiler header 14 incorporates a flare or bell configuration to facilitate swaging the tube end in place during boiler tube installation. In those situations, a substitute cutter support member having guide track elements with an alternate profile is provided. More specifically, the ends of guide track straight-run portions 100 nearest tool head subassembly 22 are in those situations each provided with a flare or bell contour that corresponds to the end flare or bell profile of the boiler header mounting bore in which boiler tube-end 12 is installed.

Figure 8:
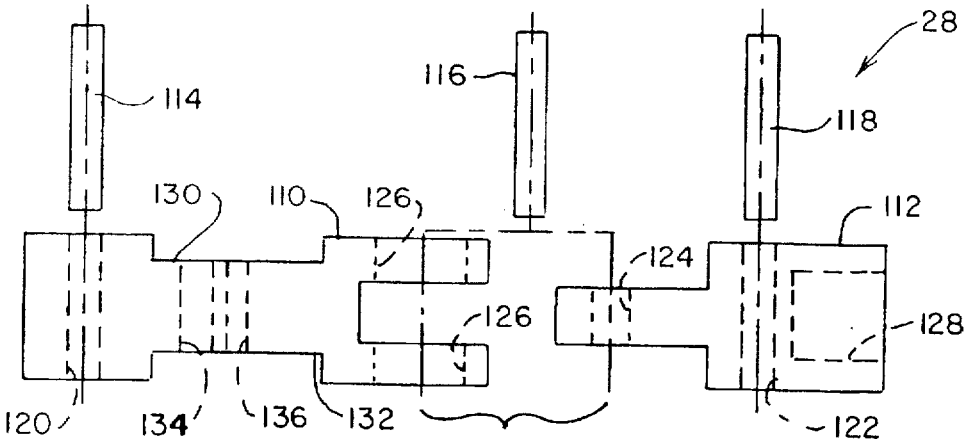
FIGS. 8 and 9 are exploded plan and elevation views, respectively, of an articulated cutter head subassembly that may be used in the practice of the invention.

The construction and operation of one form of cutter head subassembly 28 is best understood with reference to FIGS. 8, 9, and 11 through 13. As shown in FIG. 8, subassembly 28 is an articulated subassembly that is basically comprised of a clevis body portion 110, a tang body portion 112, and three trunnion-like, support axle elements 114, 116, and 118. When assembled, support axle element 114 engages bore 120 of clevis body portion 110 of subassembly 28 and each end of that axle element projects outside clevis body portion 110 a sufficient distance to properly engage and co-operate with guide tracks 98 provided in cutter support member 90. Similarly, axle element 118 co-operates with a bore or through-hole 122 provided in tang body portion 112 of subassembly 28 and its projected ends also co-operate with guide track elements 98 of cutter support member 90. Axle element 116 co-operates with the through-bore 124 of tang body portion 112 and with the identical elongate slot elements 126 provided in the legs of clevis body portion 110. Lastly, subassembly 28 is provided with a threaded bore 128 in one end of tang body portion 112 for co-operation with a correspondingly threaded end of actuator piston rod 46, and with recesses 130 and 132 and mounting bores 134 and 136 in clevis body portion 110 for receiving conventional cutter tool bit holder inserts and their included cutter tool bits.

It is important to note that the elongate slots 126 provided in the legs of the subassembly clevis body portion 110 have a "dog-leg" elevational configuration comprised of two portions 140 and 142. Slot portion 142 preferably has an axial orientation that is rotated approximately 30° from the axial rotation of slot portion 140. Such orientation departure is provided so that axle element 116 will impart a degree of rotation to clevis body portion 110 about the axis of axle element 114 during the apparatus operating return stroke.

Figure 9:
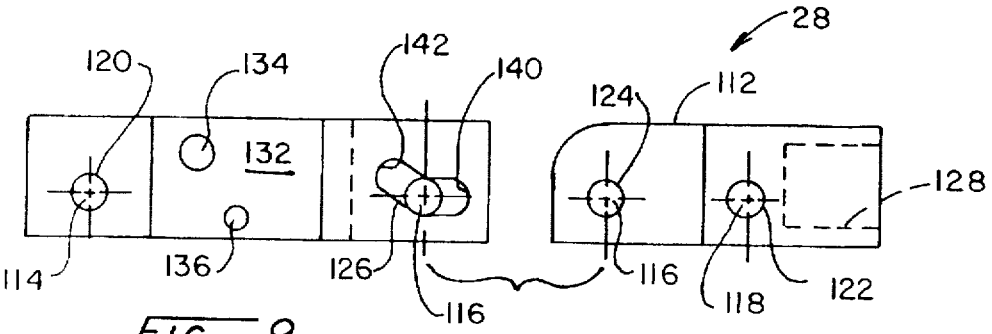
Figure 10:
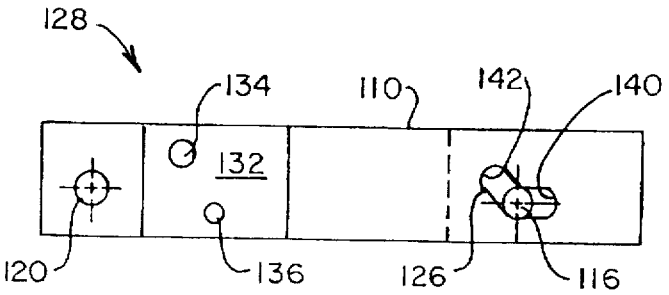
FIG. 10 is an elevation view of an alternate form of cutter head subassembly that may be used in the practice of the invention.

Another and non-articulated form of cutter subassembly 128 that may advantageously be utilized in assembly 10 is illustrated in FIG. 10. In its FIG. 10 configuration, the cutter body is comprised only of an elongated clevis body portion 110 similar to the corresponding element illustrated in FIGS. 8 and 9. The FIG. 10 trunnion-like axle element 116 is essentially a pin connection carried directly by the end of piston rod element 46 of actuator 42 rather than by a cutter head tang body portion such as element 112 of FIGS. 8 and 9.

Figure 11:
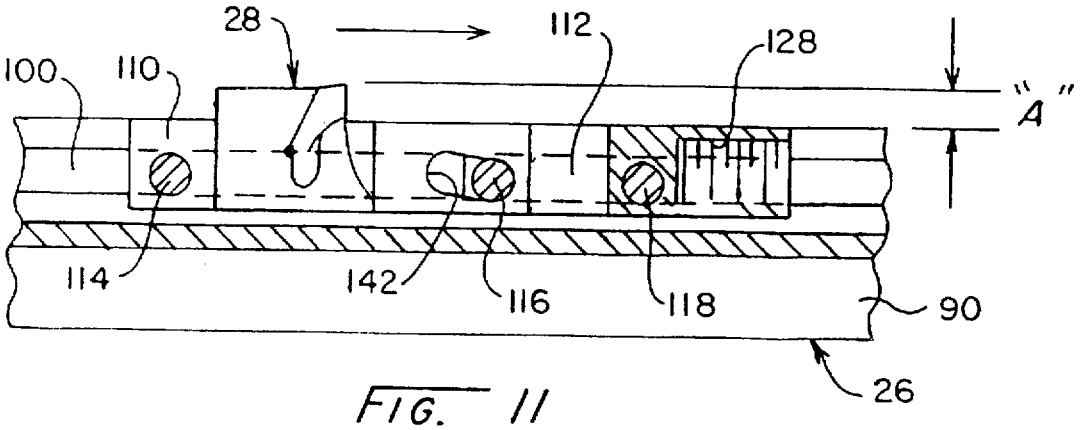
FIGS. 11 through 13 are elevation and partially sectioned views of the tool assembly invention cutter head support track and co-operating articulated cutter head subassemblies in their operational cutting stroke condition, return stroke condition, and stroke-end condition, respectively.
Figure 12:
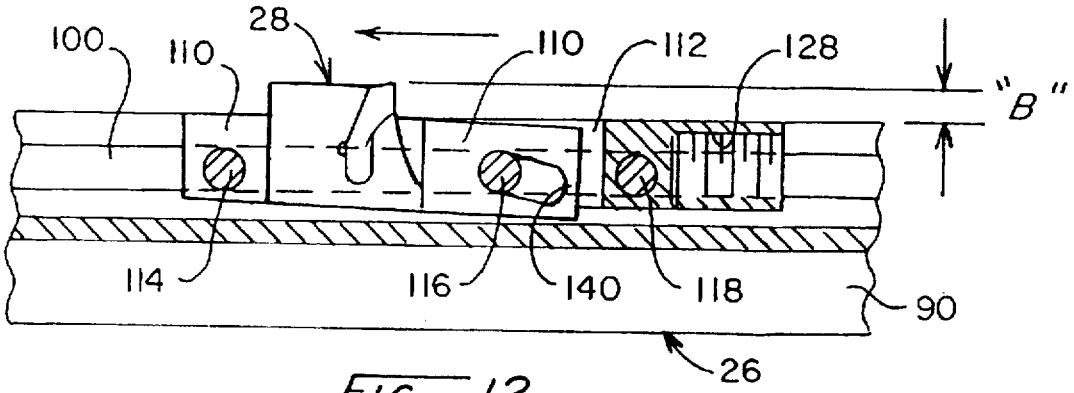
Figure 13:
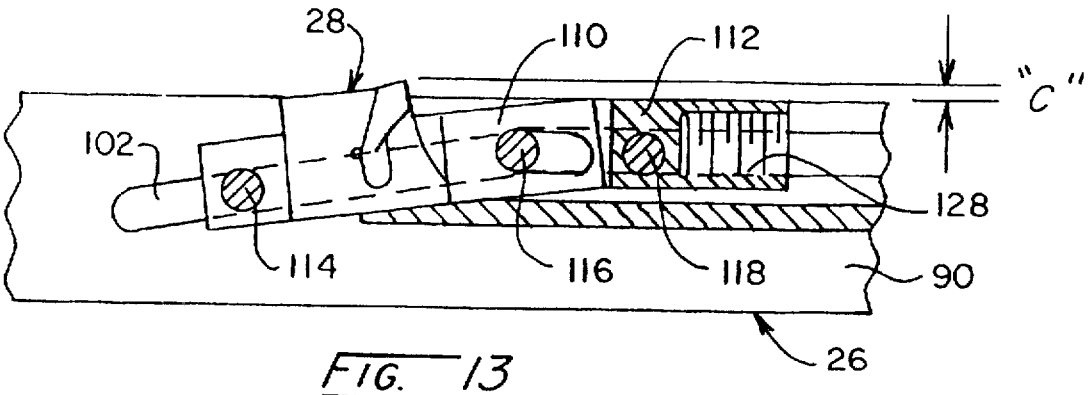

Referring to FIGS. 9 and 11, when cutter head subassembly 28 is being moved in a cutting stroke direction by actuator piston rod 46, axle element 116 engages end-portions 140 (FIG. 9) of elongate slot elements 126 so that clevis body portion 110 is positioned with the tip of the cutter head included tool bit elevated a distance "A" above the upper surface of tang body portion 112. In this cutting condition each of three subassembly axle elements is engaged with the straight-line portions 100 of opposed guide track elements 98. However, when cutter head subassembly is being moved in a return stroke direction as illustrated in FIG. 12, axle element 116 engages the end region 142 of clevis body portion slot elements 126 whereby clevis body portion is rotated about axle element 114 so that the tip of the cutter head included tool bit is elevated a smaller distance "B" above the upper surface of the subassembly tang body portion 112. In one actual embodiment of our invention the distance "B" achieved during tool assembly operation is approximately 0.030 inch less that the distance "A" thus providing more than adequate clearance for the tool bit during the apparatus return stroke.

Subassembly 28 is subsequently moved to an end-of-return stroke condition to facilitate the making of an adjustment to the elevational position of the cutter head subassembly 28 for the next succeeding cut. At the end-of-return stroke condition, the tip of the subassembly included tool bit element (or elements if more than one cutter tool bit is utilized) is positioned at an elevation lower than that illustrated in connection with FIG. 11. See FIG. 13. More specifically, the new tool bit tip is positioned a distance "C" above the upper surface of subassembly tang body portion 112. In the previously referred to actual embodiment of the invention, the distance "C" was approximately 0.090 inches below the FIG. 10 position thus affording a more than adequate elevational height adjustment zone for elevating cutter support member 90 to its next succeeding position by the actuation of stepper motor 52 and co-operating wedge rack element 94.

In an actual embodiment of our invention we utilize cutting tool bits of approximately one-eighth inch width and with an approximately one-third inch space separating the adjacent tool bits. Thus, the reciprocating cutter head subassembly and included tool bit elements upon completion of the longitudinal cuts have machine-shaped a longitudinal gap in the boiler tube end that is approximately six-tenths of an inch wide. Such in effect causes the formation of a compression gap in the retained boiler tube end that has a larger cross-section than the cross-sectional area of the metal actually removed from the tube end by the cutting action of the apparatus tool bit elements.

Boiler tubes to which the present invention has had widest application generally are in the size range of from 2 inches diameter to 4 inches diameter, and with wall thicknesses ranging approximately from 0.095 to 0.180 inches. An operating hydraulic pressure of approximately 2,000 pounds per square inch has proven satisfactory with a cutting head reciprocating frequency of 60 cycles per minute being utilized. (Hydraulic actuator strokes may range to approximately 7 to 8 inches). Also, the pulsed actuation of the apparatus stepper motor to reposition a multi-ramp wedge rack with included 30° inclined ramps has been controlled to move the cutter head subassembly and included tool cutting bits radially incrementally toward the tube end wall metal in increments of approximately 0.006 inches per completed cutting stroke.

The procedural steps for the use of gap-cutter tool assembly 10 are prefaced with the remark that it is not necessary that the candidate boiler tube for removal and replacement be initially cut near its boiler header mounting bore for the reason that the disclosed and claimed gap cutter tool assembly functions equally well when installed and co-operating with either a short tube section or a comparatively long tube section. When the tube length has been cut near its boiler header prior to gap machining, the apparatus clamp subassembly functions properly even though there is no tube interior surface for the clamp pins or clamp blades located farthest from the tool head to contact; the clamp blades situated near the apparatus adaptor block when alone contacting the tube length interior surface, either with or without surface scale, provide excellent apparatus centering and anchoring for the subsequent gap-machining steps.

When the tube length to be provided with a longitudinal gap is relatively long, the clamp subassembly through its motion take-up compression spring 84 enables the tool assembly to be satisfactorily centered and anchored at the tube header end and even though the tube diameter near the clamp remote end is appreciably smaller due to substantial scaling.

Once apparatus 10 is firmly anchored, pressurized fluid is ported to and from actuator 42 to move cutter head subassembly 28 to its end position whereat trunnion pin 114 is positioned within the end portions 102 of guide tracks 98. When in its end-of-return stroke position, stepper motor 52 is sequenced by controller 20 to elevate cutter head support track subassembly 26 to its initial cut elevation through the co-operative interaction of wedge rack element 94 and wedge shoe element 94. Normally we prefer a depth of cut of approximately 0.006 inch, and the elevation of cutter head support track assembly 26 is set accordingly. Thereafter, pressurized fluid ported to actuator 42 causes cutter head assembly to move through a cutting stroke along straight-line portion 100 of guide tracks 98, and then through a return stroke wherein the cutter head tool tip is lowered by as much as approximately 0.030 inch due to the engagement of trunnion axle element 116 engaging the slot ends 142 in cutter head body portion 110. Upon the subsequent engagement of trunnion axle 114 with the end portions 102 of guide track element 98, the tip of the cutter head tool bit insert is further lowered, e.g., by an additional approximately 0.060 inch, to its end-of-return stroke position. The system stepper motor 52 is then sequenced to elevate cutter head support track subassembly 26 by the depth of the next cut, e.g. approximately 0.006 inch. The cycle of cutting stroke, return stroke, and cutter head elevating steps is then repeated until the total depth of cut in tube end 12 has been achieved. Lastly, clamp actuator 50 is deactivated, and tool assembly 10 is withdrawn from engagement with tube end 12 to facilitate the subsequent lateral or circumferential compression of the tube end and its withdrawal from within tube header 14.

We claim:

1. A gap-cutter tool assembly for use in removing the end-portion of a boiler tube retained in a boiler header and having an inner surface and an outer wall surface, and comprising, in combination:

a tool head for contacting the exterior of said boiler tube end-portion and having a clamp actuator; and an elongated and movable clamp subassembly carried by said tool head and for insertion within said boiler tube end-portion, said elongated and movable clamp subassembly having a first set of movable friction points positioned adjacent said tool head, a second set of movable friction points positioned distant from said tool head and spaced-apart from said first set of friction points along the length of said boiler tube end-portion, a rigid and movable elongated clamp rail element attached to said clamp actuator and movably co-operating with said first set of movable friction points, with said second set of friction points, wherein movement of said clamp actuator and said clamp rail element causes movement of said first and second sets of movable friction points into and from engagement with the inner surface of said boiler tube.

2. The gap-cutter tool assembly invention defined by claim 1, wherein said second set of movable friction points comprise radially-moved friction pin elements.

3. The gap-cutter tool assembly invention defined by claim 1, wherein said first set of movable friction points comprise rotationally-moved friction blade elements.

4. The gap-cutter tool assembly invention defined by claim 1, wherein said first and second sets of movable friction points each comprise rotationally-moved friction blade elements.

5. The gap-cutter tool assembly invention defined by claim 1, and further comprised of compression spring movement take-up means, said compression spring movement take-up means being functionally installed intermediate and connected to said rigid and elongated rail element and to said second set of movable friction points to thereby allow said first and second sets of friction points to engage said boiler tube end-portion inner surface at spaced-apart longitudinal locations having different interior diameters.

6. A gap-cutter tool assembly for use in removing the end-portion of a boiler tube retained in a boiler header and having an inner surface and outer wall surface, and comprising, in combination:

a tool head for contacting the exterior of said boiler tube end-portion and having a movement actuator;

a rigid and elongated guide rail structure joined to said tool head and for insertion within said boiler tube end-portion;

an elongated cutter support member slidably engaged with and within said rigid and elongated guide rail structure and having elongated guide track means for support and guidance of a tool assembly cutter head;

elongated and ramped elevation wedge shoe means fastened to said elongated cutter support member; and elongated and ramped elevation wedge rack means connected to said tool head movement actuator and for contact with the inner surface of said boiler tube-end, said elevation wedge shoe means and elevation wedge rack means having complementary elevation profiles and causing elevational changes in the position of said cutter support member within the boiler tube end-portion when moved relative to each other by said tool head movement actuator.

7. The gap-cutter tool assembly invention defined by claim 6, wherein said elongated cutter support member has a "H"-configured cross-section comprised of upstanding leg elements interconnected by a web element, said upstanding leg elements co-operating with said rigid and elongated guide rail structure, said elongated and ramped wedge shoe means co-operating with said cutter support member web element, and said cutter support member guide track means being contained in said elongated cutter support member upstanding leg elements.

8. The gap-cutter tool assembly invention defined by claim 6, wherein said cutter support member guide track means is comprised of an opposed pair of elongated linear guide track sections and an opposed pair of inclined guide end track sections joined as a continuation of said linear guide track sections, said inclined guide track sections being positioned more distant from said tool head than said linear guide track sections.

9. A gap-cutter tool assembly for use in removing the end-portion of a boiler tube having an inner surface and an outer wall surface retained in a boiler header, and comprising, in combination:

a tool head for contacting the exterior of said boiler tube end-portion and having a bi-directional movement actuator;

a rigid and elongated guide rail structure joined to said tool head and for insertion within said boiler tube end-portion;

an elongated cutter support member slidably engaged with and within said rigid and elongated guide rail structure and having elongated guide track means with a linear orientation for support and guidance of a tool assembly cutter head; and a tool assembly cutter head engaged with and slidably supported by said elongated cutter support member elongated guide track means and movably connected to said tool head movement actuator, said tool assembly cutter head having at least one tool bit that is provided with a metal-cutting tip, and said elongated cutter support member being elevationally adjustable within said rigid and elongated guide rail structure to engage and disengage said tool assembly cutter head tool bit metal-cutting tip with and from said boiler tube end-portion inner surface.

10. The gap-cutter tool assembly invention defined by claim 9, wherein said tool assembly cutter head is comprised of a rigid body section connected to said tool head bi-directional movement actuator and having a body section angled slot element, a first trunnion axle element carried by said rigid body section and engaged with said elongated cutter support member elongated guide track means, and a second trunnion axle element carried by said tool head bi-directional movement actuator and engaged with said rigid body section angled slot element and with said elongated cutter support member elongated guide track means, said second trunnion axle element causing rotation of said rigid body section about said first trunnion axle element in two successively opposite rotational directions when said tool head bi-directional movement actuator is actuated in two successively different linear directions to thereby elevationally engage and disengage said tool assembly cutter head tool bit metal-cutting tip with and from the boiler tube end-portion inner surface.

11. The gap-cutter tool assembly defined by claim 10, wherein said elongated cutter support member elongated guide track means is comprised of a linear section and an angled end section that is joined to and oriented at an angle relative to said linear section, the elevational position of said tool assembly cutter head tool bit metal-cutting tip being changed when said tool head bi-directional movement actuator moves said tool assembly cutter head first trunnion axle element into engagement with said cutter support member guide track means angled end section to further increase the elevational separation of said tool assembly cutter head tool bit metal-cutting tip from said boiler tube end-portion inner surface.

12. The gap-cutter tool assembly invention defined by claim 9, wherein said tool assembly cutter head is articulated and is comprised of a first body section connected to said tool head bi-directional movement actuator and having a first trunnion axle element, a second body section having a second trunnion axle element and an angled slot element, and a third trunnion axle element pivotally joining said first body section to said second body section at and through said second body section angled slot element, said trunnion axle elements engaging said cutter support member guide track means in spaced-apart relation, and said third trunnion axle element causing rotation of said second body section about said second trunnion axle element in two successively opposite rotational directions when said tool head bi-directional movement actuator is actuated in two successively different linear directions to thereby elevationally engage and disengage said tool assembly cutter head tool bit metal-cutting tip with and from the boiler tube end-portion inner surface.

13. The gap-cutter tool assembly invention defined by claim 12, wherein said elongated cutter support member elongated guide track means is comprised of a linear section and an angled end section that is a joined to and oriented at an angle relative to said linear-line section, the elevational position of said tool assembly cutter head tool bit metal-cutting tip being changed when said tool head bi-directional movement actuator moves said tool assembly cutter head second trunnion axle element into engagement with said cutter support member guide track means angled end section to further increase the elevational separation of said tool assembly cutter head tool bit metal-cutting tip from said boiler tube end-portion inner surface.

* * * * *